United States Patent [19]

Tripp

[11] Patent Number: 5,020,416

[45] Date of Patent: Jun. 4, 1991

[54] MUZZLE BRAKE FOR FIREARMS

[75] Inventor: Fred D. Tripp, Austin, Tex.

[73] Assignee: Pantera Armory, Inc., Austin, Tex.

[21] Appl. No.: 287,630

[22] Filed: May 18, 1989

Related U.S. Application Data

[63] Continuation of Ser. No. 162,908, Mar. 2, 1988, abandoned, which is a continuation of Ser. No. 15,103, Feb. 17, 1987, abandoned.

[51] Int. Cl.[5] ..... F41A 21/38

[52] U.S. Cl. ..... 89/14.3

[58] Field of Search ..... 89/14.2, 14.3, 14.4

[56] References Cited

U.S. PATENT DOCUMENTS

| | | | |
|---|---|---|---|
| 817,134 | 11/1903 | Smith | 89/14.3 |
| 1,259,251 | 3/1918 | Love | 181/223 |
| 1,636,357 | 7/1927 | Cutts | 89/14.3 |
| 2,206,568 | 4/1938 | Hughes | 89/14.3 |
| 2,499,428 | 10/1948 | Tiffany | 89/14.3 |
| 2,656,637 | 10/1953 | Richards | 89/14.3 |
| 2,712,193 | 7/1955 | Mathis . | |
| 2,770,904 | 11/1956 | Weiss . | |
| 2,796,005 | 6/1957 | Shapel . | |
| 2,883,781 | 4/1989 | Harvey . | |
| 2,916,970 | 12/1959 | Mutter . | |
| 3,021,633 | 2/1962 | Beretta | 42/105 |
| 3,152,510 | 10/1964 | Ashbrook et al. . | |
| 3,243,910 | 4/1966 | Weiser | 89/14.3 |
| 3,367,055 | 2/1968 | Powell . | |
| 3,707,899 | 2/1973 | Perrine | 89/14.3 |
| 3,710,683 | 1/1973 | Kaltmann | 89/14.3 |
| 3,808,943 | 5/1974 | Kelly | 89/14.3 |
| 3,858,481 | 1/1975 | Elliott . | |
| 4,058,050 | 11/1977 | Brouthers | 89/14.3 |
| 4,066,000 | 1/1978 | Rostocil | 89/14.3 |
| 4,307,652 | 12/1981 | Witt | 89/14.3 |
| 4,392,413 | 7/1983 | Gwinn | 89/14.3 |
| 4,429,614 | 2/1984 | Tocco | 89/14.3 |
| 4,716,809 | 1/1988 | A'Costa | 89/14.3 |

FOREIGN PATENT DOCUMENTS

| | | | |
|---|---|---|---|
| 645927 | 6/1937 | Fed. Rep. of Germany | 89/14.3 |
| 2433564 | 1/1976 | Fed. Rep. of Germany | 89/14.3 |
| 468865 | 12/1936 | France | 89/14.3 |
| 897759 | 3/1945 | France | 89/14.3 |
| 512773 | 1/1953 | Italy . | |
| 240479 | 4/1946 | Switzerland | 89/14.3 |
| 465697 | 5/1937 | United Kingdom | 89/14.3 |
| 2072813 | 10/1981 | United Kingdom | 89/14.3 |

*Primary Examiner*—Charles T. Jordan
*Assistant Examiner*—Stephen Johnson
*Attorney, Agent, or Firm*—James L. Jackson

[57] ABSTRACT

A muzzle brake for firearms including a housing positioned at the end of a gun barrel which defines a gas receiving expansion chamber. A plurality of vent slots or openings are formed in the housing and are oriented to direct escaping gases from the chamber in an upwardly or upwardly and rearwardly direction. The chamber and slotted housing are so defined that reverberating shock waves build up within the chamber and escape sequentially so as to substantially increase the duration of the upwardly and rearwardly directed gas venting pulse and thus retard upward muzzle jump of the gun barrel and minimize the felt recoil experienced by the user. The muzzle brake apparatus may be adjustable to provide for selective muzzle deflection in any suitable direction or to neutralize muzzle deflection.

5 Claims, 4 Drawing Sheets

FIG.1
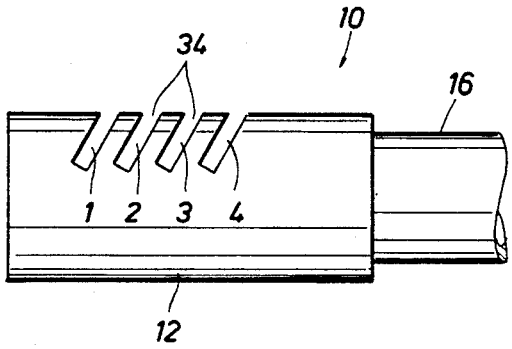
FIG.3A
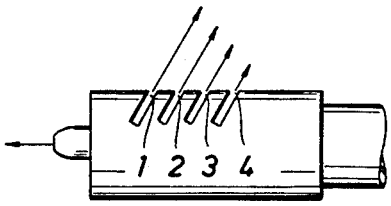
FIG.3B
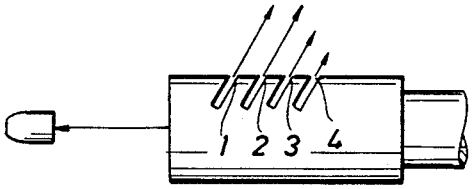
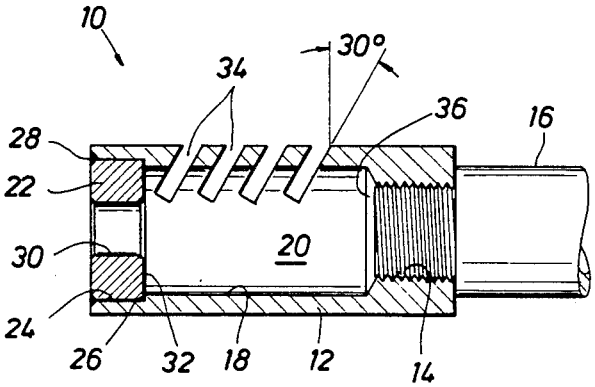
FIG.3C
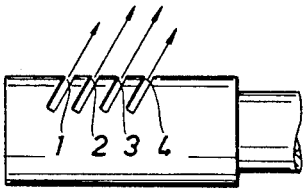
FIG. 2
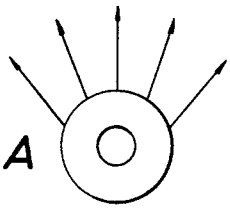
FIG. 2A
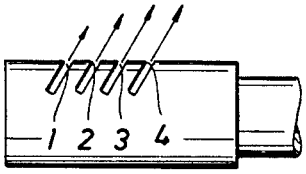
FIG.15
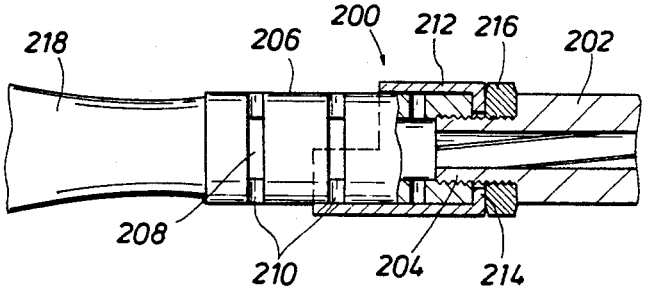
FIG.3D
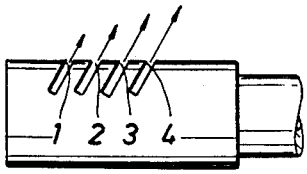
FIG.3E FIG. 4
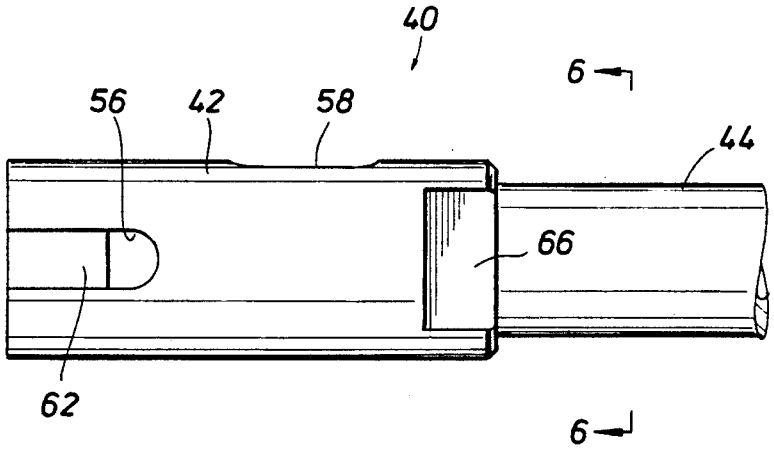
FIG. 5
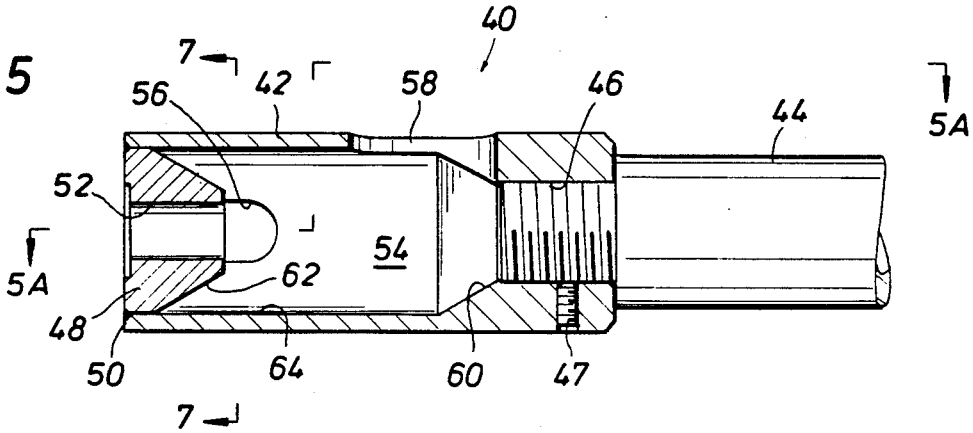
FIG. 5A
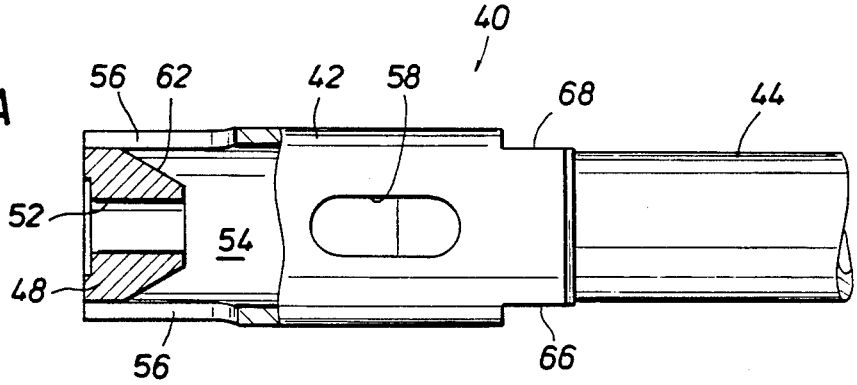
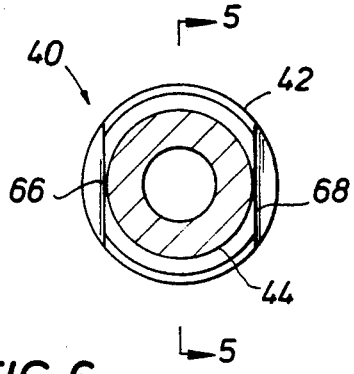
FIG. 6
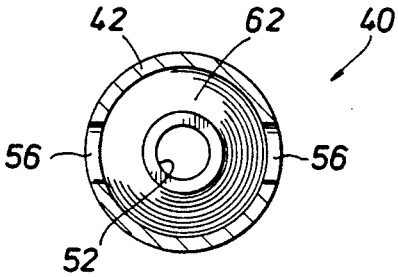
FIG. 7

FIG. 8
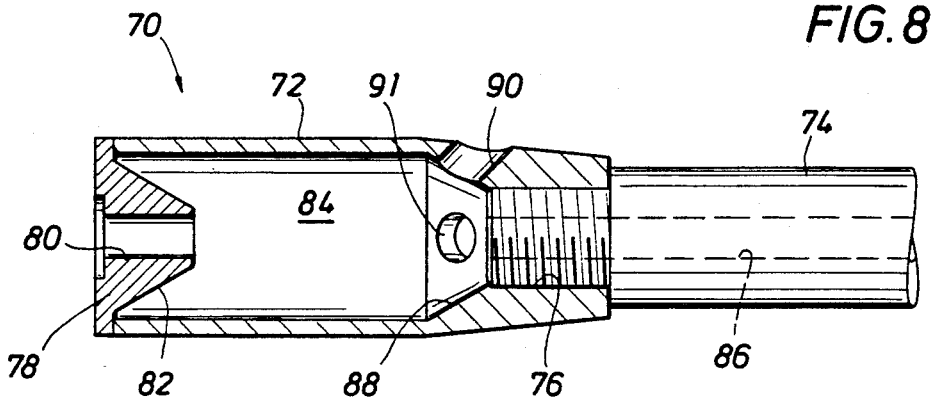
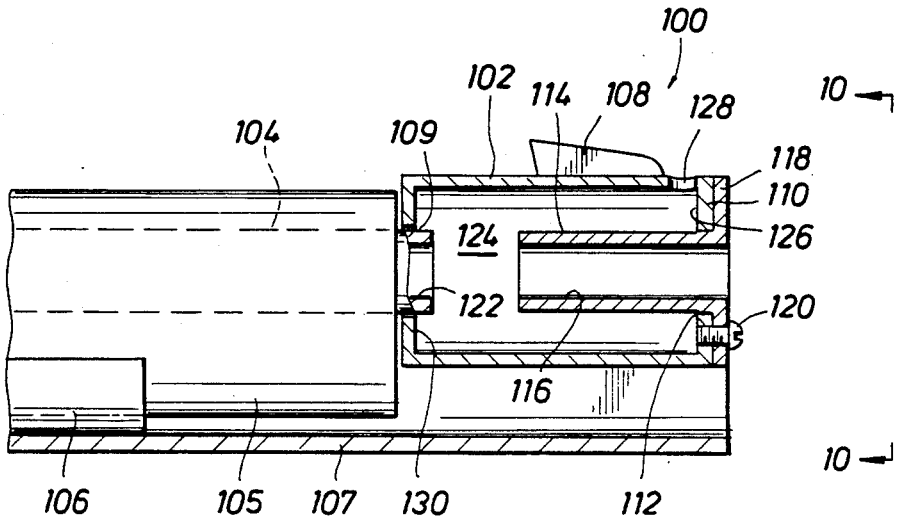
FIG. 9
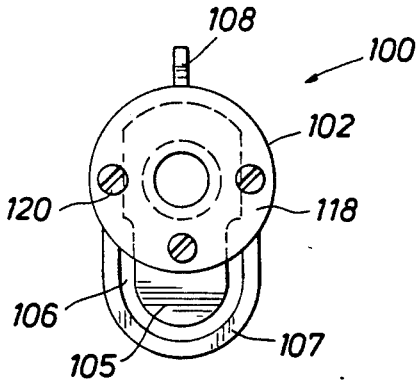
FIG. 10
FIG. 11
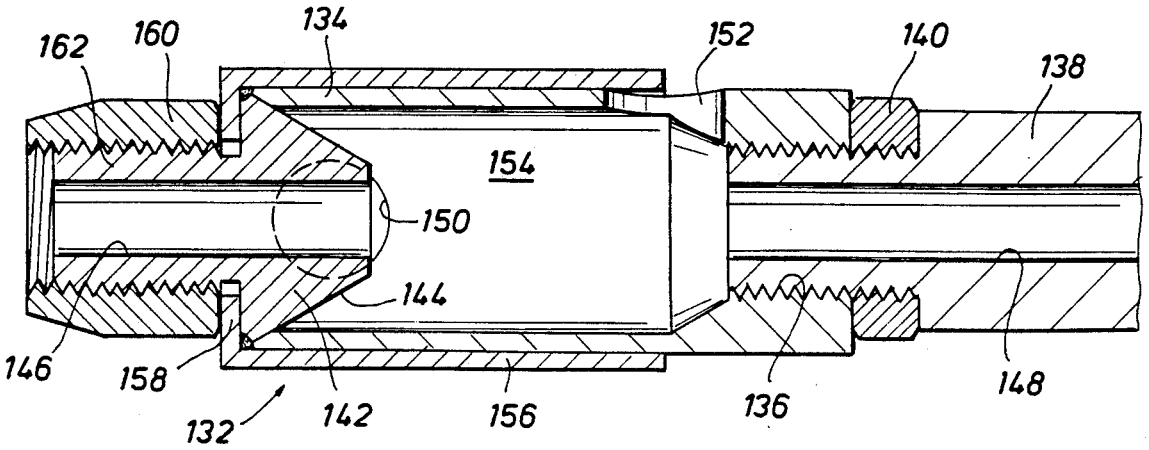

FIG. 12
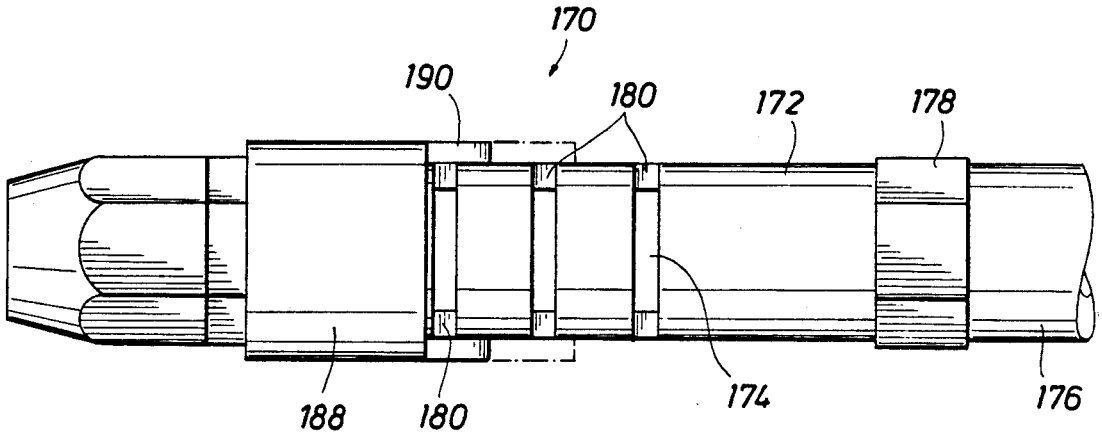
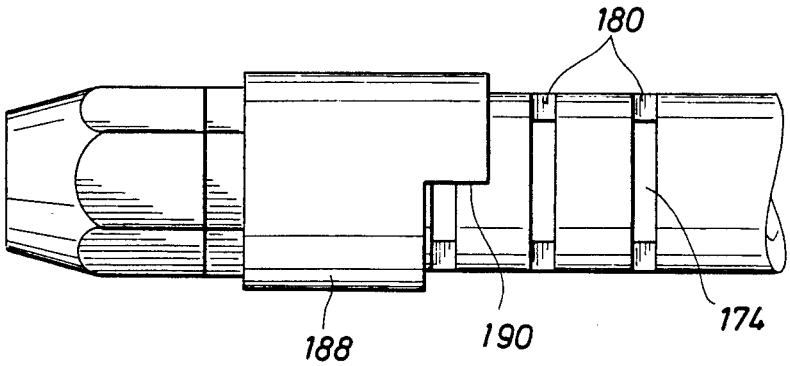
FIG. 13
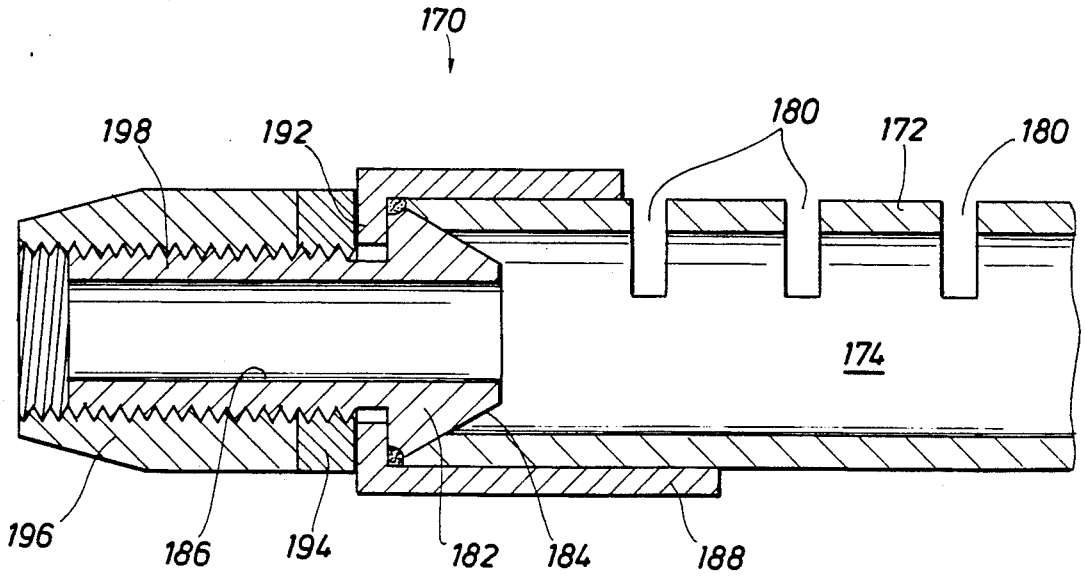
FIG. 14

MUZZLE BRAKE FOR FIREARMS

This is a continuation of co-pending application Ser. No. 07/162,908 filed on 3/2/88 now abandoned which is a continuation of application Ser. No. 07/015,103 filed Feb. 27, 1987 now abandoned.

FIELD OF THE INVENTION

This invention relates generally to firearms such as rifles, pistols, shot guns, etc. and more specifically concerns the provision of apparatus for minimizing muzzle jump of firearms as the result of discharge and to decrease the felt recoil experience by the user.

BACKGROUND OF THE INVENTION

It is well known that a discharging fire arm, such as a pistol, rifle or the like will move rearwardly as the result of recoil and that the muzzle of the firearm will move upwardly. The rearward movement of the firearm which is due to the sudden release of, expanding gases is known as recoil. As a bullet progresses down the rifled barrel of a hand gun or rifle, the rifling within the barrel imparts a rotary motion to the bullet, thus causing it to spin during its trajectory from the barrel to the target. The bullet spin enhances the accuracy of the bullet during its flight. As this twist or spin is imparted to the bullet, a simultaneous reverse torque is imparted to the firearm. The simultaneous influence of rearward firearm movement or recoil at bullet discharge and bullet imparted torque causes the gun muzzle to jump upwardly and slightly to the right or left depending upon the direction twist of lands and grooves of the barrel. During the firing of individual rounds, where ample time is available for careful aiming and controlled trigger pull, the muzzle jump that occurs naturally is not a particularly annoying factor. During rapid fire conditions, however, such as during tournament shooting or the case of military operations after each muzzle jump, the firearm is completely misaligned with respect to the target and must be re-aimed at the target as quickly and efficiently as possible. It is desirable, therefore, to provide a firearm system where muzzle jump is substantially eliminated or directionally controlled so as to aid rather than hamper efficient rapid firing activities.

Another significant problem in conjunction with the use of firearms is the recoil felt by the user. Especially under circumstances where very high energy is imparted to large caliber or heavier weight bullets the user of the firearm will typically experience a severe level of sharply induced recoil. In certain cases this recoil is sufficiently heavy that it will disturb the user's ability to control accuracy of shooting. Also, the sharpness and severity of firearm discharge can cause bruising of the muscles of the user to the extent that shooting firearms of the high energy, heavy caliber type can become a painful and annoying experience. It is desirable, therefore, to provide a firearm system having the capability of extending the duration of the gas venting pulse to thus reduce the felt recoil experienced by the user and to minimize the possibility of bruising or other injury that might otherwise be experienced.

THE PRIOR ART

The problems of muzzle jump and felt recoil have existed since the use of firearms began. As the energy level of firearms has steadily increased, interest has also steadily increased in the development of systems for reducing felt recoil and/or muzzle jump. The following United States Patents set forth the various devices utilizing the gases of combustion to accomplish various activities including recoil abatement and minimizing muzzle jump. U.S. Pat. No. 1,259,251 of Love discloses a firearm attachment intended for silencing the report of discharge. The device defines an internal chamber having several specifically designed partitions and multiple circumferential apertures. U.S. Pat. No. 2,206,568 of Hughes discloses a recoil control device adapted for attachment for the end of a gun barrel. This device defines internal compartments which are communicated by rearward directed passages. U.S. Pat. No. 2,499,428 of Tiffany discloses a muzzle brake for directing the muzzle blast and combustion gases away from the gunner in substantial parallelism to the line of fire. The device, which also functions as a recoil reducer, defines an internal-chamber within which is located a pair of blast brake devices in the form of partitions. U.S. Pat. No. 3,021,633 of Beretta discloses a combination muzzle brake and grenade launcher for portable firearms. The device defines an internal chamber forming multiple ports. These ports are to conduct discharge gas for launching of a grenade. U.S. Pat. No. 3,707,899 of Perrine discloses a firearm muzzle deflector forming a housing with a baffled surface at the forward end and forwardly directed discrete holes at the upper rear portion of the housing. U.S. Pat. No. 3,710,683 of Kaltmann discloses a muzzle brake with a flash hider for automatic weapons and guns. This device forms a plurality of rows of radial bores distributed over the periphery thereof. U.S. Pat. No. 3,808,943 of Kelly discloses a hand gun and rifle barrel device having trapezoidal slots in the forward upper portion of the barrel for creating gas vectors for counteracting muzzle jump together with an induced anti-recoil action and reduction of noise and blow back of hot gases. U.S. Pat. No. 4,058,050 of Brouthers discloses a barrel and shroud construction for reducing recoil and jumping of a firearm. U.S. Pat. No. 4,307,652 of Witt et al, discloses a muzzle guard for firearms for attachment to the end of a gun barrel. This muzzle guard acts like a break against recoil lessens the noise and flash of the discharge, also lessens the impact of the gases on the bullet right after the bullet leaves the barrel and allows the escape of the compressed air in front of the bullet. U.S. Pat. No. 4,392,413 of Gwinn, Jr., discloses a muzzle attachment for a firearm barrel which functions both as a muzzle brake to reduce recoil of the firearm and is a compensator to reduce upward movement or muzzle jump of the muzzle portion of the firearm barrel when the firearm is fired. U.S. Pat. No. 4,429,614 of Tocco discloses a slip-on type compensator for revolvers which defines a bullet passage and an upwardly directed slot intersecting the bullet passage. Gases escaping through the slot in an upward direction counterbalance upward jump of the barrel.

SUMMARY OF THE INVENTION

It is therefore a primary feature of the present invention to provide a novel muzzle brake mechanism for firearms having the capability of utilizing the escaping gases at the muzzle of the barrel for counterbalancing both muzzle jump and felt recoil when the firearm is discharged.

It is also a feature of this invention to provide a mechanism for reducing muzzle jump and felt recoil in discharging firearms without causing any reduction in bullet velocity or accuracy.

It is another feature of this invention to provide a novel muzzle brake mechanism which essentially provides for muzzle deflection and increase in the period of the gas pulse after exit of the bullet without affecting or negating the recoil reaction of muzzle jump and rearward movement that occurs before bullet exit.

It is also a feature of this invention to employ the technique of "vectoring" or "re-vectoring" gases rearwardly away from the muzzle and in direct opposition to the rearward movement of the firearm simultaneously while increasing the length of time or time period that the vector of gases lasts and thus increasing the period of time during which the re-vectored gases counteract energy of recoil imparted to the user.

Among the various features of this invention is contemplated the provision of a muzzle brake device incorporating an expansion chamber for re-vectoring gases in a rearwardly direction, lengthens the effective time period for gas energy transmission and increases the velocity of the vectored gases.

It is another feature of this invention to provide a novel muzzle brake mechanism for firearms incorporating an expansion chamber which functions as a tuned resonant reservoir, capacitor or plenum in the form of a cavity which is filled faster than the pressure is bled off, thus developing a back pressure after the bullet has left the expansion chamber.

Another feature of this invention concerns the provision of novel muzzle brake mechanism incorporating an expansion chamber which is capable of being altered dimensionally or "tuned" to desired expansion chamber volume and chamber bleed off area for a particular caliber and firearm and which may be provided in a fixed dimensional form or be defined by an adjustable mechanism for on site tuning by the user.

It is also a feature of this invention to provide a novel muzzle brake mechanism which serves as a base for the front sight of the firearm adds to the barrel/muzzle tip weight and serves to steady the firearm while aiming.

It is an even further feature of this invention to provide a novel muzzle brake mechanism which offers adjustability by the user to cause vectoring of the muzzle in any desired direction such as for cancellation of the normal right-hand swing experienced when a right handed person fires a long firearm such as a rifle.

Briefly, the various features of the present invention are provided by a muzzle brake mechanism in the form of a housing structure which is adapted to be threaded to or otherwise attached to tip or muzzle portion of a firearm barrel. Alternatively, the muzzle brake may be formed integrally with the barrel of the firearm. The housing defines an internal chamber having a wall structure at the free extremity thereof which defines a bullet orifice or port. The bullet orifice is in registry with the center line of the barrel bore and is of a size permitting exit of the bullet without touching the side walls of the bullet orifice. Nevertheless, the bullet port is closely sized to the dimension of the bullet to thus prevent escape of a significant volume of muzzle gas as the bullet is passing through the orifice. The housing structure is formed to define a plurality of vent ports which collectively define the desired chamber bleed off area. The vent ports may be defined by spaced upwardly directed slots or upwardly and rearwardly directly slots depending upon the circumstances involved. The vent ports may also be defined by combinations of laterally directed ports and vertically directed ports. In the case of slot type vent ports, the slots are disposed in spaced relation along the length of the housing, the number and dimension of the slots being configured according to the character of the firearm for which it is intended. Other mechanical aspects of the muzzle brake device are also selectable according to the character of firearm and cartridge to be utilized. For example, such features as the inside diameter, inside length, inside diameter of the bullet exit orifice, shape, angle, number and location of exit vents, shape of the bullet exit orifice plate, location of the barrel muzzle to the expansion chamber and the rear shape of the chamber cavity are all features that can be selectively provided within the scope of engineering design for provision of a tuned muzzle brake device functioning in accordance with the method of this invention. For example, the bullet orifice may be eccentrically located relative to the longitudinal axis of the expansion chamber and housing.

Additionally, the muzzle brake mechanism of this invention may be provided in a fixed model having no movable parts or in an adjustable model which is capable of being tuned by the user to accomplish desired results. For example, the adjustable model may be efficiently adjusted to provide an upward rise of the barrel upon firing, to provide essentially zero barrel movement or to provide negative or downward barrel movement as the firearm is discharged. Depending upon the activity for which the firearm is used, the user has the capability of efficiently controlling the muzzle brake device to yield discharge induced muzzle movement which enhances the capability of use. The basic method by which the muzzle brake mechanism of this invention functions is the vectoring or revectoring of muzzle gas from a tuned internal chamber in an upward and rearward direction to overcome, counterbalance or reduce muzzle jump and the controlled venting of vectored gases from the chamber for the purpose of substantially increasing the period of gas energy transmission, thus minimizing felt recoil on the part of the user.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings, which drawings form a part of this specification.

It is to be noted, however, that the appended drawings illustrate only typical embodiments of this invention and are therefore not to be considered limiting of its scope, for the invention may admit to other equally effective embodiments. Referring now to the accompanying drawings, which are for illustrative purposes only:

FIG. 1 is an elevational view of a muzzle brake mechanism constructed in accordance with the teachings of this invention and attached to the barrel of a firearm.

FIG. 2 is a sectional view of the muzzle brake mechanism of FIG. 1 showing the internal structural details thereof.

FIG. 2*a* is a diagrammatical end view illustration of the fan shaped configuration of vectored gas discharged through the vent ports of the apparatus of FIG. 2.

FIGS. 3*a*–3*e* illustrate the character of gas vectoring from the various gas vectoring slots in diagrammatical form for illustration of pressure wave build up and vectoring activities which materially increase the time duration of the gas venting pulse experienced by the user.

FIG. 4 is an elevational view of a modified embodiment of the present invention.

FIG. 5 is a sectional view of the muzzle brake device of FIG. 4 showing the internal details thereof.

FIG. 5*a* is a sectional view taken along line 5*a*–5*e* of FIG. 5.

FIG. 6 is a sectional view taken along line 6—6 of FIG. 5.

FIG. 7 is a sectional view taken along line 7—7 of FIG. 5.

FIG. 8 is a sectional view of a muzzle brake device representing a further modified embodiment of this invention.

FIG. 9 is a sectional view of a muzzle brake device representing another embodiment of this invention.

FIG. 10 is an end view taken along line 10—10 of FIG. 9.

FIG. 11 is a sectional view of an adjustable muzzle brake device representing another embodiment of this invention.

FIG. 12 is an elevational view of an adjustable muzzle brake device representing another embodiment of this invention.

FIG. 13 is a fragmentary elevational view of the muzzle brake device of FIG. 12 showing one of the vent ports partially covered.

FIG. 14 is a sectional view of the adjustable muzzle brake device of FIG. 12.

FIG. 15 is a partial sectional view of an adjustable muzzle brake representing another embodiment of this invention.

DETAILED DESCRIPTION OF PREFERRED EMBODIMENT

Referring now to the drawings and to FIGS. 1 and 2 a fixed embodiment of this invention may conveniently take the form illustrated generally at 10. The muzzle brake device includes a housing structure 12 having a reduced diameter internally threaded portion 14 which is adapted to receive the externally threaded portion of a gun barrel 16, the housing 12 defines an enlarged internal bore 18 defining an internal chamber 20 which is closed at the free extremity of the housing by means of a bullet orifice plate 22. The housing bore 18 is enlarged at its outer portion as shown at 24, thus forming an annular internal shoulder 26 against which the orifice plate 22 is seated. The outer portion-of the orifice plate is welded to the housing 12 as shown at 28 by means of a circular weld thus causing the bullet orifice plate to be integral with the housing structure. The bullet orifice plate is formed with an orifice or port 30 through which the bullet passes as it exits from the bore of the firearm barrel. The bullet orifice may be eccentrically located relative to the longitudinal axis of the housing and expansion chamber. The orifice 30 is in registry with the axis of the bore of the barrel and is only slightly larger than the maximum diameter of the bullet to insure that the bullet does not touch the internal surface of the orifice as it is in trajectory from the barrel. The orifice 30, however is sufficiently small in relation to the dimension of the bullet that very little space exists between the bullet and the cylindrical orifice surface thereby preventing all but minimal gas escape through the bullet orifice during passage of the bullet through the orifice. The orifice plate 22 further defines an interior, generally planer surface 32 which functions to reflect discharge gases being emitted from the muzzle after the bullet has exited the bore of the barrel. Surface 32 also functions to reflect air pushed ahead of the bullet even though the air has a negligible effect upon muzzle deflection and recoil of the firearms.

It is desirable to minimize or eliminate the normal characteristic known as muzzle jump which occurs upon discharge of the firearm. To accomplish this feature, the housing structure 12 is formed to define a plurality of upwardly and rearwardly directed gas venting slots or ports 34. Slots 34 are angulated within a range of from about 15 degrees to about 50 degrees from the vertical, optimum angulation being in the order of about 30 degrees from the vertical. Venting slots 34 are formed so that they extend around the upper and upper side portions of the housing 12, thus causing vented gases to form a fan shaped configuration in the manner shown diagrammatically in FIG. 2*a*. Thus, upon discharge of the firearm as the bullet clears the bore of the barrel and passes through the bullet orifice 30 of the orifice plate 22 the high pressure gas developed by the burning gun powder will expand into the expansion chamber 20. Thereafter, it will be vented through the upwardly and/or rearwardly directed slots 34 thus causing a consequent downwardly directed force acting upon the muzzle brake 10 which substantially counterbalances the upwardly directed forces producing muzzle jump.

It is also desirable to provide a muzzle brake device which has the effect of reducing felt recoil of the firearm even though it does not reduce the energy causing recoil. The same upwardly and rearwardly directed venting slots, together with the expansion chamber 20 has the effect of significantly extending the period during which recoil forces occur. In firearms without muzzle brake devices of this nature discharge of gas at the muzzle is instantaneous and therefore recoil forces imparted to the firearm are also substantially instantaneous. There occurs, therefore, a short duration, high intensity recoil energy pulse which is felt by the user. In the case of hand guns, this instantaneous recoil force is absorbed by the hand or hands of the user and can be sufficiently severe in heavy bore magnum type firearms that the muscles in the hand of the user can become bruised. In accordance with the teachings of this invention, the duration of the energy pulse of recoil is substantially extended in comparison to the instantaneous energy pulse described above. The energy of recoil is not decreased but rather is spread over a longer period of time and therefore the recoil force felt by the user is much less severe. In fact, even when firing large bore hand guns such as the .44 Remington Magnum, felt recoil reduction is in the order of from 50 to 75%.

From the standpoint of operation, as the firearm discharges and the bullet clears the bore of the barrel, enters the expansion chamber 20 and passes through the bullet orifice 30, the gases of discharge are received by the expansion chamber. These gases are in the form of a number of consecutive shock waves which are reflected from the planar surface 32 and by the opposite tapered end wall 36 and the exposed end surface of the muzzle portion of barrel 16. If desired, the end wall 36 may be of flat configuration. As the gases enter the expansion chamber 20, initial gas movement is toward the planar surface 32 and therefore only nominal amounts of gas will begin to escape at the vent ports 34.

As the initial shock wave encounters the planer surface 32 a high pressure area is created within chamber 20 in the region of vent port 1. As shown in FIG. 3*a*, vectoring of gases begins as shown diagrammatically with the venting gas of port 1 being at higher pressure in comparison to that of ports 2, 3 and 4. As gases continue from the bore into the expansion chamber in the form of additional shock waves, the shock waves tend to build up in layer like form from the planar reflection surface 32 toward tapered the rear surface 36 of the chamber 20. The arrows shown in FIGS. 3*a*–3*e* illustrate the build up and venting of gases from the expansion chamber. In FIG. 3*b*, high pressure gases have accumulated progressively to the region of vent port slot 2 and therefore the force or pressure arrow at vent slot 2 approaches that of vent slot 1. In FIG. 3*b*, the build up of shock waves has progressed to the region of vent slot 3 and therefore the force or pressure arrow at vent slot 3 approaches the level shown at vent slot 2. At this point, the pressure or vector force arrow at end vent slot 1 is shown to be depleting.

In FIG. 3*d*, the build up of shock waves has reached the region of vent slot 4 and therefore pressure or vector force arrows 3 and 4 are about equal while those of vent slots of 1 and 2 are shown to be depleting. As shown in FIG. 3*e*, the pressure or vector force arrow at slot 4 is shown to be at its maximum range while the pressure or vector forces at slots 1, 2 or 3 are shown to be further depleting. This effect continues until all of the gases have been vented from the expansion chamber 20. Obviously, after bullet exit through the orifice 30, some of the gases escape at the bullet orifice. Thus, sequential shock wave build up and depletion from the expansion chamber serves to materially extend the energy pulse of the vectored gas. The change in shooting activities is quite noticeable by the user. The felt recoil is materially reduced while at the same time muzzle jump is reduced by 50 to 75%. The user is enabled, therefore, to comfortably fire large bore firearms such as hand guns and rifles many times without feeling the level of discomfort would be experienced when shooting the same firearms not equipped with the muzzle brake of this invention.

During tests of the muzzle brake apparatus of this invention gunpowder residue build up on the muzzle brake structure has proven the pressure, force and vector analysis which is described in conjunction with FIGS. 3*a*–3*e*.

Another embodiment of this invention is shown in FIGS. 4–6, generally at 40. The device 40 incorporates a housing structure 42 which is attached by threads or by any other suitable means to a gun barrel 44. As shown in FIG. 5, the housing 42 defines an internally threaded extremity 46 which receives the externally threaded terminal portion of the barrel 44. The housing 42 is closed at the free extremity thereof by a bullet orifice member 48 which is welded or otherwise secured to the free extremity 50 of the housing 42. The orifice member 48 defines a bullet orifice 52 of similar nature as that set forth at 30 in FIG. 2.

Venting of discharge gases from the expansion chamber 54 defined by the housing 42 is accomplished through a pair of lateral vent ports 56 which are shown in FIGS. 4 and 5 in the form of longitudinal vent slots defined by opposed side portions of the housing. The housing also defines an upper vent slot 58 which is also of elongated form and which intersects tapered internal surface 60 forming the inner end surface of the expansion chamber. The bullet orifice member defines a tapered external surface 62 which provides for reflection of shock waves in much the same manner as planar surface 32 of FIG. 2. The tapered surface 62, however, causes radial deflection of shock waves toward the inner surface 64 of the housing as well as reflecting shock waves rearwardly toward the tapered end wall 60 of the housing.

Externally of the housing 42, the rear portion of the housing defines opposed flat surfaces 66 and 68 which enable the housing to be engaged by a wrench for tightening or loosening the threaded connection between the housing and gun barrel.

As shock waves exit from the muzzle of the gun barrel and progress forwardly, the shock waves engage the tapered surface 62 of the bullet orifice member 48. Lateral portions of the shock waves are directed laterally through the opposed lateral vent openings or slots 56. Certain portions of gases are reflected rearwardly and exit through the upper elongated vent port 58. The direction of these reflected gases through the vent port 58 is upwardly and rearwardly thus developing force vectors to counteract muzzle jump of the firearm.

FIG. 8 represents a modified muzzle brake mechanism illustrated generally at 70 and incorporating a housing 72 for attachment to the muzzle portion of a gun barrel 74. Again, the housing 72 defines an internally threaded portion 76 adapted to receive the externally threaded portion of the gun barrel 74. Housing 72 is closed at the free extremity thereof by an orifice member 78 defining a bullet orifice 80 and a tapered internal deflection surface 82. The housing and orifice member form an internal expansion chamber 84 for receiving gases discharged from the bore 86 of the barrel 74. The inner portion of the housing defines a tapered gas deflection surface 88 which is shown to be at an angle of about 30 degrees with respect to the horizontal or center-line of the barrel and housing. The housing also defines three gas vent passages, two of which are shown at 90 and 91. These vent passages are shown to be oriented at an angle of about 45 degrees with respect to the center-line of the bore 86.

As the gases of bullet discharge enter the expansion chamber 74, such gases are reflected from the tapered surface 82, both radially and rearwardly. This causes pressure wave build up within the chamber 84 which is vented laterally and rearwardly through the lateral ports 91 and vented laterally and rearwardly through vent port 91. The laterally, downwardly and rearwardly venting of gases from the expansion chamber 84 develops vectoring or re-vectoring of gas discharge from the expansion chamber and thus develops forces counteracting muzzle jump. Simultaneously, the controlled venting of gases from the expansion chamber substantially increases the duration of the energy pulse of recoil, thus making the recoil felt by the user seem substantially less although the same energy of recoil is transmitted to the user.

Another embodiment of this invention is illustrated in FIGS. 9 and 10. This embodiment is adapted especially for attachment to the apparatus of semi-automatic hand guns, such as those manufactured by Colt. In this embodiment, shown generally at 100, a housing structure 102 is removably attached to or made an integral part of the frame structure 106 of the hand gun. It should be born in mind that the hand gun incorporates a recoil energized slide which is reciprocated by recoil energy upon firing. The barrel 104 has only slight movement relative to the frame 106 of the hand gun. To the housing 102 is attached a gun sight 108 thereby locating the sight a greater distance from the rear sight than normal thereby providing for greater accuracy of aiming. The housing 102 is closed by an end wall 110 having a centralized opening 112 through which a bullet tube 114 extends. The bullet tube defines a bullet orifice 116. The bullet tube 114 extends from an outer plate 118 which is secured by the housing plate 110 by means of one or more screws 120. If desired the bullet tube 114 may extend forwardly of plate 118 rather than rearwardly as shown, such as by simply reversing the plate 118, and it may be of larger dimension than the barrel or of the same dimension and rifled or of smooth bore.

For support of the housing 102 in immovable relation to the frame 106 an elongated, V-shaped support channel 107, to which the housing 102 is fixed such as by welding, is fixed to the frame 106 by screws or by any other suitable means. The free extremity of the barrel fits closely within a barrel port 109 but the fit is loose and thus does not interfere with barrel movement. The muzzle brake also permits unrestricted movement of the slide 105.

Although the housing 102 is shown to be of cylindrical form, it may be of generally oval cross-sectional configuration and the bullet port and bullet tubes may be eccentrically located relative to the housing structure.

After the bullet emerges from the bore 122 of the barrel 104 and enters the bullet passage 116 of bullet tube 114 discharge gases enter the expansion chamber 124 of the housing and progress toward the planar reflection surface 126 of end plate 110. A part of these gases begin exiting upwardly from the vent port 128 of the housing thereby initiating vector forces tending to urge the muzzle brake downwardly in counteracting relation with upward muzzle jump that is normally experienced. The discharge gases reverberate and stack up in sequential manner within the expansion chamber reflecting from surfaces 126 and 130. The discharge of gas from the expansion chamber 124 extends over a substantial period of time as compared to the instantaneous period of muzzle jump and recoil forces that normally occur. The result is that the felt recoil of shooting the firearm is less and muzzle jump is materially reduced.

Referring now to FIG. 11 the embodiment disclosed therein is of adjustable character, enabling the user to adjust the vectoring forces that are developed as the firearm is discharged. The adjustable muzzle brake device of FIG. 11 is shown generally at 132 and incorporates a housing structure 134 having an internally threaded portion 136 adapting the housing for releasable connection with the externally threaded muzzle portion of a gun barrel 138. A lock nut 140 is employed to securely lock the housing structure 134 to the gun barrel. The free end portion of the housing 134 is closed by means of a bullet orifice element 142 defining a tapered gas deflection surface 144 and forming an internal bullet passage 146 allowing a bullet exiting from the bore 148 of the barrel 138 to pass freely through the bullet passage or orifice without touching any of the structure defining the passage 146.

The housing 144 defines a pair of lateral vent ports and an upper vent port 152 for venting discharge gases from the expansion chamber 154 defined by the housing. The ports 150 and 152 are of adjustable dimension, being controlled by positioning of a vent adjustment sleeve 156 located about the housing 134. The vent adjustment sleeve 156 is provided with an inwardly directed end flange 158 which is secured by a lock nut attached to an externally threaded forwardly projecting portion 162 of the orifice element 142. The vent adjustment sleeve 156 defines lateral openings which correspond to the dimension and positioning of lateral vent openings 150 of the housing 134. Thus, upon relative rotation of the sleeve 156 relative to the housing 134, the effective dimension of the lateral vent ports 150 may be adjusted. Adjustment of the effective dimension of the vertical vent port 152 is accomplished by providing adjustment sleeve elements 156 of differing length. This enables the user to select a particular adjustment sleeve length that is proper for desired vectoring and re-vectoring of discharge gases to achieve desired muzzle deflection activity. Through employment of an adjustment sleeve of this nature, the muzzle of the firearm barrel may be deflected upwardly by a slight amount neutralized for substantially no muzzle movement, or deflective downwardly depending upon the desires of the user. It should be noted that upon slight downward movement of the barrel during shooting, the target remains in view. Re-aiming is then relatively simple and efficient.

In FIGS. 12, 13 and 14, another adjustable embodiment of the present invention is disclosed generally at 170. In this case a housing structure 172 is provided defining an internal expansion chamber 174. Again, the housing is provided with an internally threaded inner extremity which is received by the externally threaded muzzle portion of a gun barrel 176. The inner extremity of the housing is provided with a hexagonal configuration as shown at 178, thus allowing the housing to be tightened with respect to the gun barrel by means of a conventional wrench. The housing is formed to define a plurality of gas vent slots 180 through which discharge gas is vented from the expansion chamber 174. The free extremity of the housing 172 is closed by an orifice element 182 defining a tapered gas deflection surface 184 and a bullet passage 186. A vent adjustment sleeve element 188 is positioned about the housing 172 and defines a cut-away portion 190 which is rotatable relative to a vent slot 180 to thus decrease the effective dimension of the vent slot. The vent adjustment sleeve 188 incorporates an inwardly directed terminal flange 192 which is secured by means of a pair of lock nuts 194 and 196 which are received by an externally threaded forwardly projecting portion 198 of the orifice member 182. For adjustment of the effective dimension of the first vent slot 180, the lock nuts 194 and 196 are loosened and the vent adjustment sleeve 188 is rotated as far as is appropriate. The lock nuts 194 and 196 are then retightened to secure the adjustment sleeve in place. If, upon discharge of the firearm the appropriate muzzle deflection does not occur, the user simply again loosens the lock nuts, adjusts the position of the adjustment sleeve and then retightens the lock nuts.

If covering or partial covering of other ones of the vent slots 180 is desired, the user will then select a longer vent adjustment sleeve again having a cut away portion such as that shown at 190 in FIG. 13. The rear most one of the vent slots 180 will always remain open; otherwise, the muzzle brake device would be rendered non functional. The adjustable muzzle brake mechanism of FIGS. 12–14 is especially usable under circumstances where military or police weapons have the capability of automatic fire. Ordinarily, when automatic firing occurs, even with a light, high velocity caliber cartridge, the muzzle jump of each round being discharged causes unavoidable muzzle climb even though the user may be applying downward force during automatic fire. By appropriately adjusting the sleeve 188, muzzle deflection can be reduced to near zero or to negative deflection. These features provide the user with infinite gas vectoring capability for muzzle deflection control. This enables the user to achieve very accurate fire even under automatic firing conditions.

Where the muzzle brake device incorporates a bullet sleeve to define the bullet exit port, the sleeve may extend forwardly of the orifice plate or forward wall of the expansion chamber. For example, as explained above in connection with FIGS. 9 and 10, the bullet tube 114 may extend forwardly of the orifice plate 110 instead of rearwardly thereof as shown.

Further, the muzzle brake may also define an integral flash hider as shown in FIG. 14. In such case the integral device forms an internal expansion chamber forming a forward wall having a bullet port. Forwardly of the bullet port the device may form an elongated diverging chamber through which the bullet must pass. The wall structure forming the diverging chamber may define slots which control or subdue the flash of the discharging cartridge.

Referring now to FIG. 15 an embodiment of this invention is disclosed generally at 200 which incorporates an integral flash hider and a vent adjustment sleeve. The vent adjustment sleeve is reversed from the position of element 188 shown in FIGS. 13 and 14 but the function of it is similar. In this case the firearm barrel 202 will have a threaded end 204 received the internal threads of a muzzle brake housing structure 206. The body structure defines an internal gas expansion chamber 208 and a plurality of gas vent slots 210 which may be similar to the gas vent slots 180 of FIGS. 12–14.

A vent adjustment sleeve 212 of similar nature to sleeve 188 surrounds the body or housing 206 with an inwardly directed flange 214 thereof secured by means of a lock nut 216. The lock nut is loosened to permit rotational adjustment of sleeve 212 in the manner and for the purpose described above in connection with FIGS. 12–14. The housing structure 206 may be provided with an integral flash hider 218 of any suitable design.

As shown in broken lines in FIG. 15 the vent adjustment sleeve is completely backing the rear vent slot and is partially blocking the intermediate vent slot. For complete blocking of the rear and intermediate vent slots and partially blocking the forward vent slot the sleeve 212 must be removed and replaced with a longer vent control sleeve as explained above.

In view of the foregoing, it is respectfully submitted that the present invention is one well adapted to attain all of the objects and features hereinabove set forth, together with other features which are inherent in the apparatus itself. It will be understood that certain combinations and subcombinations are of utility and may be employed without reference to other features and subcombinations. This is contemplated by and is within the scope of the present invention.

What is claimed is:

1. A muzzle brake for firearms comprising:

(a) housing means defining front and rear ends and having connection means at the rear end thereof for attachment to the free end of a gun barrel and defining generally cylindrical side wall means and end wall means at the front end thereof cooperating to define an elongated gas expansion chamber receiving muzzle gases exiting a bore of the gun barrel after a bullet has cleared the bore during gun discharge:

(b) said end wall means defining a bullet orifice aligned with the bore of said gun barrel;

(c) said side wall means defining a plurality of elongated vent ports extending transversally of said housing means and along upper and side portions of said housing means and being positioned in spaced relation along said housing means, said vent ports vectoring venting muzzle gases in a controlled manner and developing vectored forces controlling muzzle jump of said gun barrel, said vent ports being so located relative to said end wall means such that gas pressure rise at said vent ports is sequential beginning with the vent port nearest side end wall means and progressing rearward, causing a period of time for vented gas vectoring from said expansion chamber to be materially lengthened as compared with instantaneous gas venting from a conventional firearm barrel and thus materially reducing felt recoil of said firearms;

(d) a generally cylindrical vent adjustment sleeve positioned in rotatable relation about said cylindrical housing and forming vent adjustment shoulder means being adjustably positioned rotationally about said housing means to selectively cover at least a side part of at least one of said vent ports to thus control an effective dimension of said one of said vent ports and to control directional orientation of muzzle gases exiting said one vent port relative to said housing means for selectively orienting muzzle jump of said firearm, said vent adjustment shoulder means having outer walls disposed in generally parallel relation with a longitudinal axis of said cylindrical housing; and (e) means for locking said vent adjustment shoulder means at said rotationally adjustable position.

2. A muzzle brake and recoil period extender for firearms comprising:

(a) generally cylindrical housing means having a first end thereof for connection to a muzzle portion of a firearm barrel and forming an internal expansion chamber through which a bullet passes during its trajectory from a bore of said firearm barrel, said expansion chamber receiving muzzle gas discharged from a cartridge which propels said bullet through said bore, said housing means having a second end forming an end opening;

(b) orifice means closing said end opening of said housing means and forming an internal shock wave reflection surface and a bullet port for aligned registry with said bore of said barrel;

(c) said housing means defining a plurality of vent slots being arranged in spaced relation along an upper portion of said housing means and being oriented in transverse relation to a longitudinal axis of said housing means and causing directionally controlled venting of gas from said expansion chamber for counteracting muzzle rise upon firearm discharge, said vent slots being selectively located and sized to extend a period of gas venting from said expansion chamber for counteracting muzzle rise of said firearm barrel upon firearm discharge;

(d) a generally cylindrical vent adjustment sleeve forming a vent adjustment shoulder and being positioned about said housing means and forming a vent adjustment shoulder having side walls oriented in a generally parallel relation with said longitudinal axis of said housing means and being selectively positionable in at least partially blocking relation with a side portion of at least one of said vent slots thereby selectively controlling directional vectoring of vented gas from said expansion chamber and thus permitting development of gas induced forces on said muzzle portion of said firearm barrel for selectively controlling muzzle movement of said muzzle brake and barrel within a range including upward, neutral and downward; and (e) means for locking said generally cylindrical vent adjustment sleeve in a selected position thereof.

3. An adjustable muzzle brake for firearms, comprising:

(a) a generally cylindrical housing forming an elongated gas expansion chamber therein and having a rear end adapted for assembly to the free end of a firearm barrel and having a front end forming a bullet passage centrally thereof, said housing further forming a plurality of upwardly directed transversely oriented vent slots disposed in spaced relation along the length thereof and being in communication with said gas expansion chamber;

(b) a generally cylindrical vent and adjustment sleeve positioned in rotatable relation about said cylindrical housing and having an extending portion forming vent adjustment shoulder means being positionable for selectively closing at least a side portion of at least one of said vent slots to thus control the effective dimension of said at least one of said vent slots and achieve directional orientation of muzzle gases exiting therefrom for selectively orienting the muzzle jump of said firearm;

(c) locking means being provided on said generally cylindrical vent adjustment sleeve, said locking means being a locking flange extending transversely from one end of said generally cylindrical vent adjustment sleeve; and (d) lock means for releasably securing said locking means and thus said generally cylindrical vent adjustment sleeve in immovable relation with said generally cylindrical housing, said lock means being a lock nut for selectively securing said locking flange in immovable relation with said generally cylindrical housing.

4. An adjustable muzzle brake for firearms as recited in claim 3, wherein (a) said free end of said firearm barrel forms a threaded extension; and (b) said lock nut is in threaded engagement with said threaded extension.

5. An adjustable muzzle brake for firearms as recited in claim 3, wherein:

(a) an orifice element defines a closure for said front end of said generally cylindrical housing and defines said bullet passage, said orifice element further defining a threaded axial extension; and (b) said lock nut being receivable by said threaded axial extension.

* * * * *